US007013831B1

(12) United States Patent
Garelick

(10) Patent No.: US 7,013,831 B1
(45) Date of Patent: Mar. 21, 2006

(54) TWIST ON MOUNTING DEVICE FOR BOAT DECK

(75) Inventor: Richard J. Garelick, Minneapolis, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 0 days.

(21) Appl. No.: 11/154,169

(22) Filed: Jun. 17, 2005

(51) Int. Cl.
*B63B 17/00* (2006.01)

(52) U.S. Cl. ..... 114/364; 114/363; 114/343

(58) Field of Classification Search ..... 114/343, 114/363, 364; 248/188, 230.2, 231.31; 403/332, 403/297, 229, 374, 374.5
See application file for complete search history.

(56) References Cited

U.S. PATENT DOCUMENTS

| | | | | |
|---|---|---|---|---|
| 4,278,376 | A * | 7/1981 | Hunter | 410/130 |
| 6,047,940 | A * | 4/2000 | Kaplan | 248/501 |
| 6,571,403 | B1 * | 6/2003 | Wheaton | 4/496 |

* cited by examiner

*Primary Examiner*—Ed Swinehart
(74) *Attorney, Agent, or Firm*—Jacobson and Johnson

(57) ABSTRACT

For removably coupling a boat apparatus, such as a boat table or seat, to a boat deck, a base plate having an arcuate or curved clamping slot is attached to the boat deck and the table or the like is securely coupled to a base assembly having a downward extending clamping device. The base assembly is placed on the base plate with the clamping device engaged in the clamping slot and the base assembly is then twisted or turned so that the clamping device slides to the end of the slot and a member on the base assembly is then manually operated to releasably clamp the clamping device securely in place in the associated slot.

10 Claims, 6 Drawing Sheets

TWIST ON MOUNTING DEVICE FOR BOAT DECK

FIELD OF THE INVENTION

The invention is aimed at providing a device for releasably securely mounting a boat apparatus, such as a table or seat, to the boat deck in a manner so that wobble is minimized yet it is relatively easy and convenient to remove the apparatus from the mounting device. As a feature, the mounting device has a very low profile so after the apparatus has been removed the mounting device is not an obstruction on the boat deck.

Description of the Prior Art

Copending U.S. patent application Ser. No. 11/029,772 filed Jan. 5, 2005 "DEVICE FOR MOUNTING BOAT APPARATUS TO BOAT DECK" by the same applicant as the instant application describes in some detail some of the earlier prior art devices. One such mounting device illustrated in U.S. Pat. No. 5,385,323 by Garelick is referred to as a surface mount which has a base member having a central opening for receiving the bottom end of a seat-supporting rigid tubular pedestal or stanchion and a flange which rests on the top surface of the boat deck and is rigidly secured to the boat deck by a set of bolts suitably spaced around the base flange. Another low profile mounting device is referred to as a flush mount which is an annular rigid plate member recessed into a boat deck and secured in place by a series of bolts. A similar stanchion or pedestal is secured at its lower end in the annular opening of the plate member to support a boat apparatus such as a table top.

Also as part of the prior art, the device described in the aforementioned copending application has a low profile base plate which is fixedly attached to the boat deck. The top of the base plate contains a straight line slot which may be in the form of a keyhole slot. A base assembly in the form of a rigid cast or molded or machined spider rests on the top or upper side of the base plate and has a clamping device extending downward from its underside for engaging the slot in the base plate. The base assembly has a generally centrally located annular opening to which the underside of a boat apparatus, such as a table, can be coupled. When the clamping device is located in or at the base slot the base assembly is slid in a straight line to a desired location and a manually operable member, such as a lever arm, is operated to securely clamp the base assembly onto the base plate. To remove the boat apparatus the clamping device is manually released and the base assembly is moved in a straight line to disengage the clamping device from the base plate slot. Similar to the aforementioned device, the present invention is aimed at providing a secure, virtually wobble-free low profile mounting device on the boat deck yet allowing the apparatus which is attached to the mounting device to be conveniently removed if desired. As a further feature, when the base assembly with attached boat seat or table is removed, the low profile of the base plate serves to minimize it as an obstruction on the boat deck.

SUMMARY OF THE INVENTION

Similar to the device described in the aforementioned copending application, the present invention has a low profile generally circular base plate for attachment to a boat deck but with the top or upper side of the base plate containing a curved slot. A generally circular base assembly in the form of a rigid cast or molded or machined spider rests on the upper side or top of the base plate and has a clamping device extending downward from its underside for engaging the slot in the base plate. The base assembly has a generally centrally located annular opening to which the underside of a boat apparatus, such as a table or seat, can be coupled. When the base assembly is located at the desired position, with the clamping device located in the base slot, the base assembly is twisted or turned or rotated to slide the clamping device in the curved slot to a desired position. A manually operable member, such as a lever arm which is attached in some fashion to the base assembly and is mechanically coupled to the clamping device, is operated to tighten the clamping device in the base slot to securely clamp the base assembly onto the base plate. To remove the boat apparatus the lever arm is operated to manually release the clamping device and the base assembly is turned or twisted to disengage the clamping device from the base plate slot so that the base assembly can be lifted off the base plate.

As a feature, the underside of the base assembly has a shallow concave or saucer-like shape and the upper side of the base plate has a concave shape to mate with the underside of the base assembly. When the base assembly and base plate are clamped together the engagement of the outer or peripheral surfaces helps to eliminate or minimize wobble.

DESCRIPTION OF THE PREFERRED EMBODIMENTS

Figure 1:
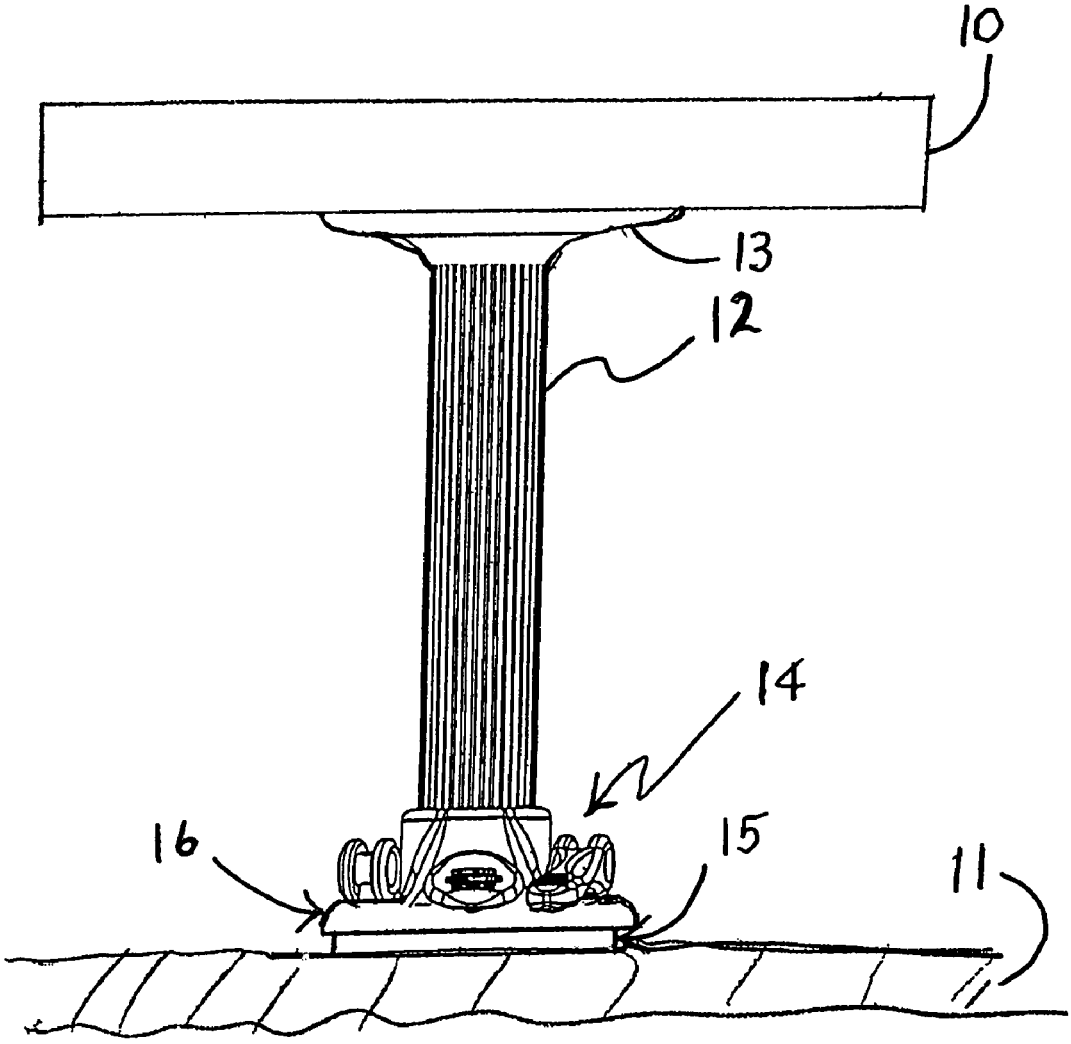
FIG. 1 is an illustration of an embodiment of the invention as used for supporting an elevated table top.
Figure 2:
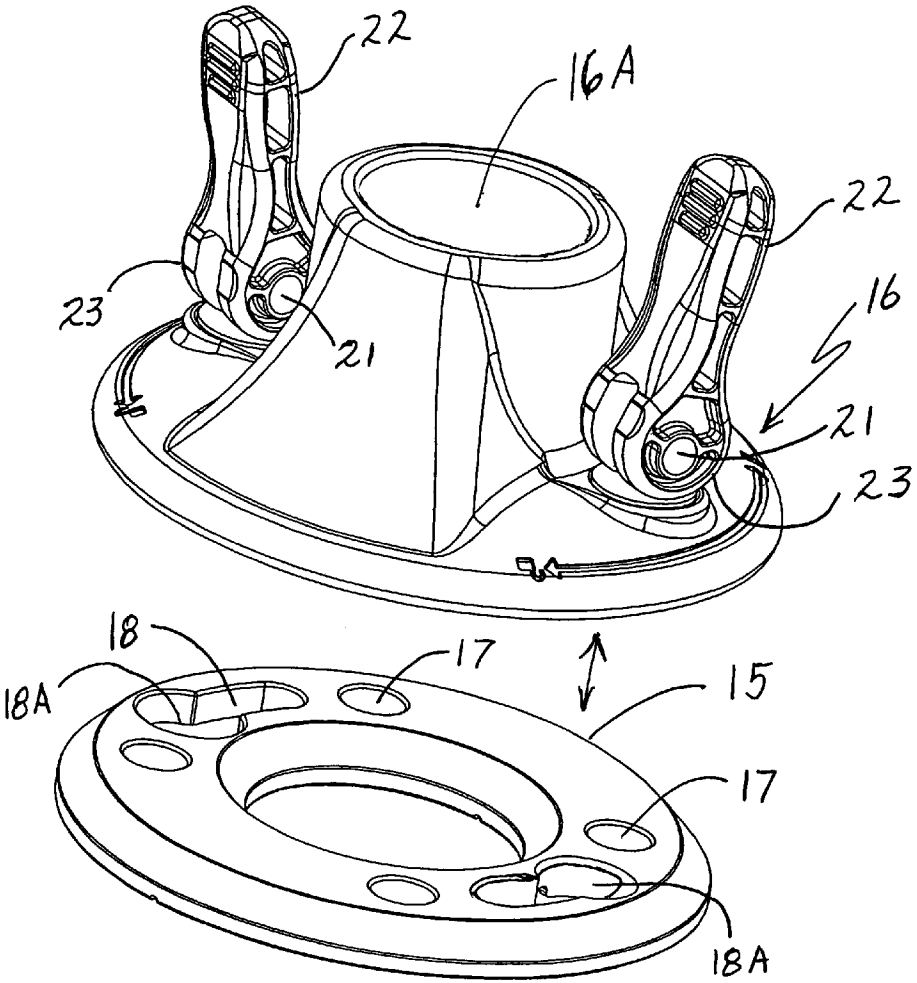
FIG. 2 is a blow-apart of an embodiment of the invention.
Figure 3:
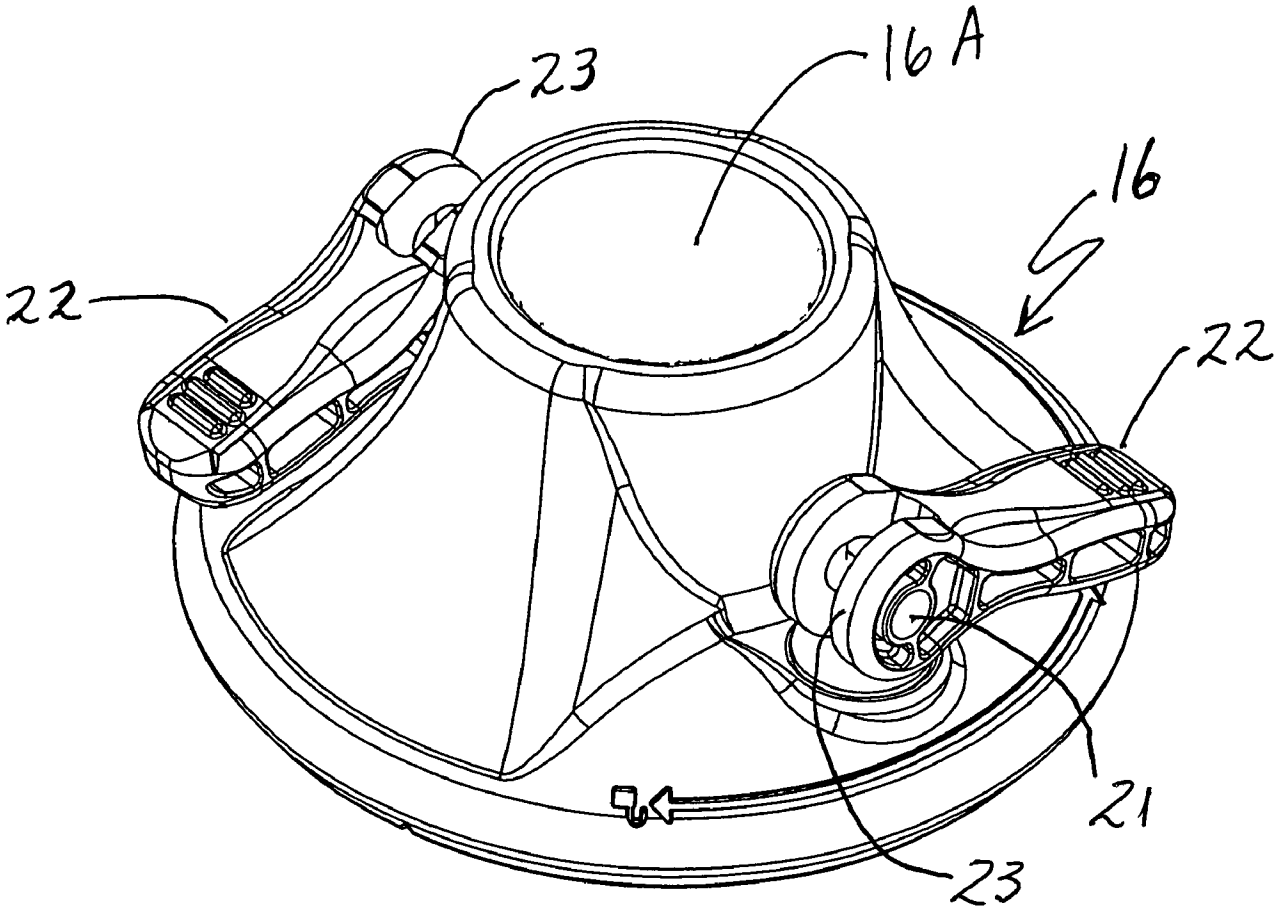
FIG. 3 is a perspective view of an embodiment of the invention in the clamped condition.
Figure 4:
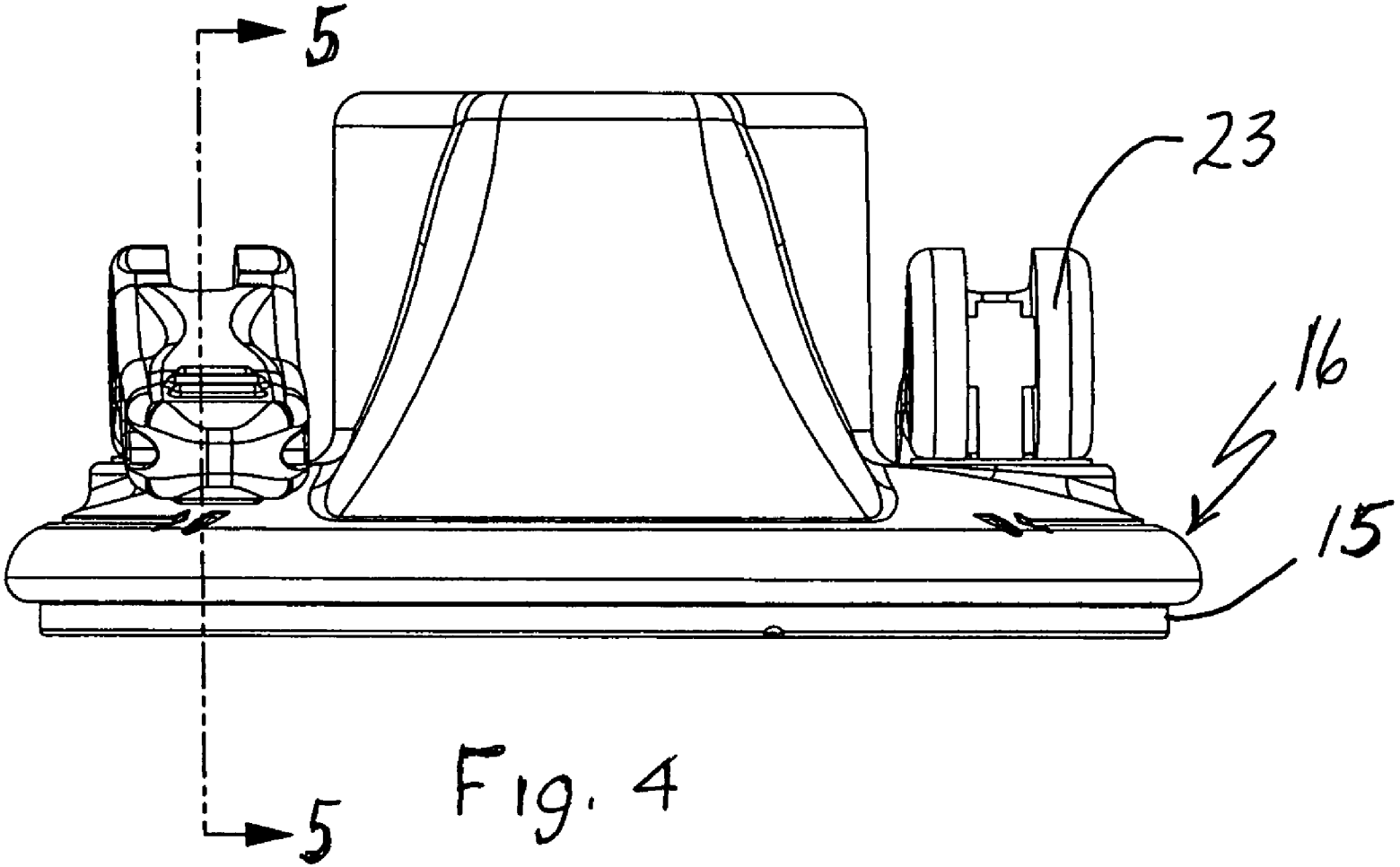
FIG. 4 is a side view in the clamped condition.
Figure 5:
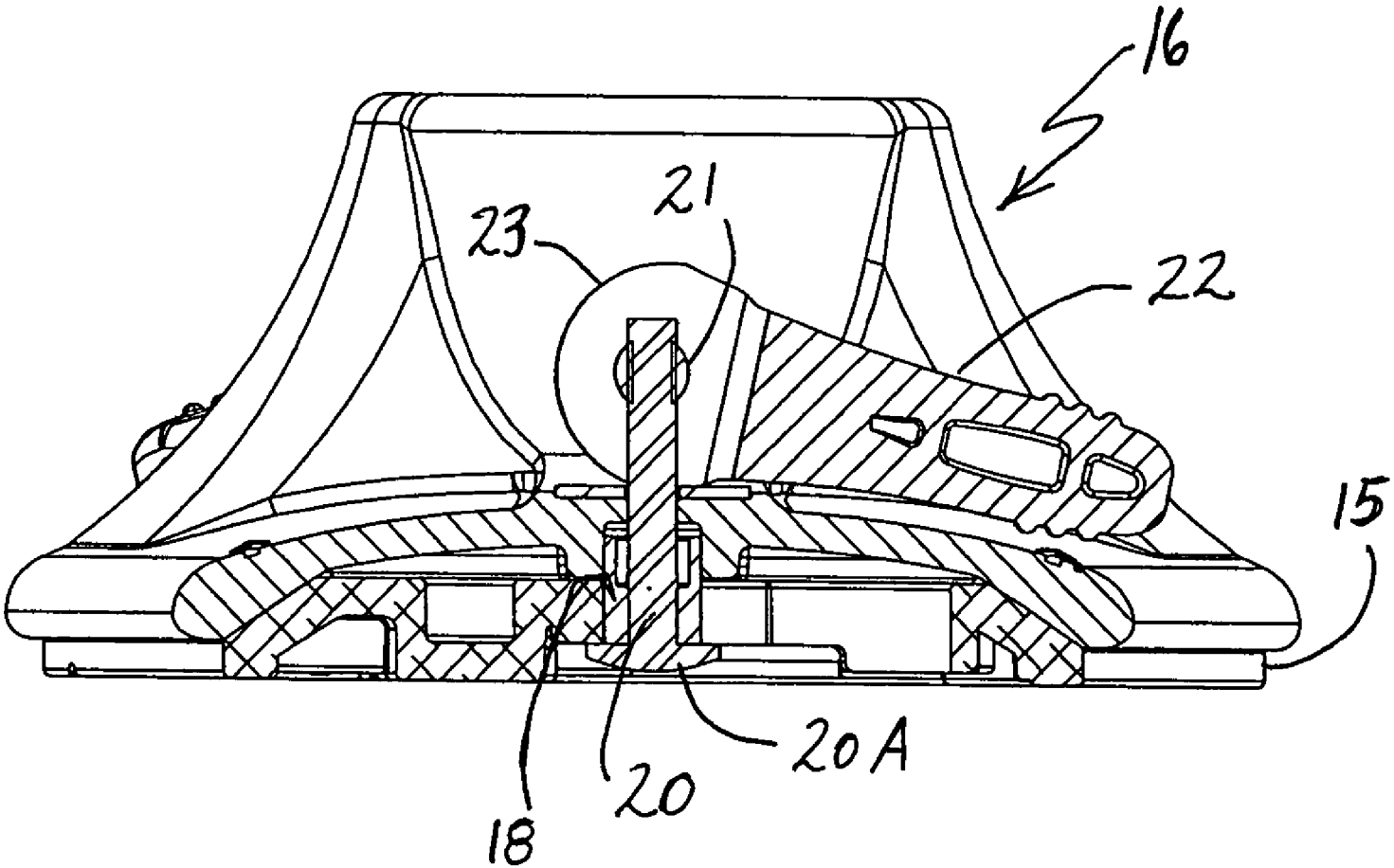
FIG. 5 is a sectioned view of FIG. 4.
Figure 6:
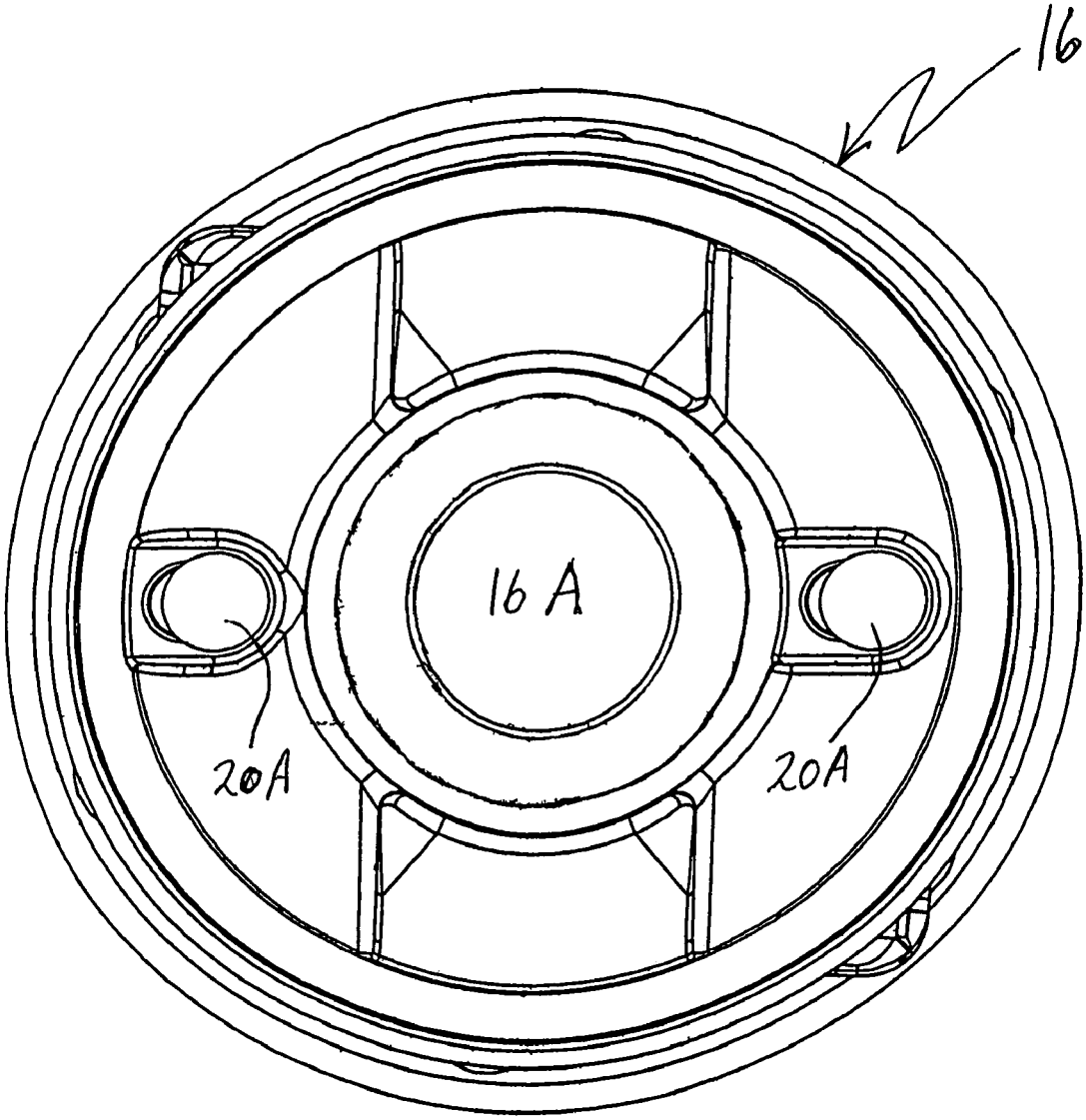
FIG. 6 is a view of the underside of an embodiment of the base assembly.

Typically and conventionally a boat apparatus such as a table top 10 is mounted in an elevated position onto a boat deck, generally designated by reference numeral 11, by a rigid tubular support 12 sometimes referred to interchangeably as a pedestal or stanchion. The top end of pedestal 12 is coupled to the underside of the table 10 by a suitable mechanism generally designated by reference numeral 13 which usually permits the user to adjust the table top as desired. In addition, conventionally there is provided means, not shown, for adjusting the height or elevation of the table top. The present invention provides a mechanism generally designated by reference number 14 for attaching or coupling the underside of the table top 10 to the boat deck 11 in a manner to minimize the amount of wobble that might otherwise occur at the mounting mechanism and yet permit the table to be conveniently and readily removed from the mounting mechanism when desired. The mounting mechanism 14 comprises a generally circular base plate 15 which rests on the surface of the deck and a generally circular base assembly 16 which rests on the top side of base plate 15. In the illustrated embodiment base assembly 16 has a generally centrally located opening 16A to receive and securely hold the bottom portion of pedestal 12. One way of attaching pedestal 12 to the base is to have opening 16A and/or either the lower end of pedestal 12 or opening 16A slightly tapered so the frictional engagement between the two is made secure when wedged together. Base plate 15 is secured or attached to the deck by bolts, not shown, through a series of recessed holes 17. Base plate 15 has a pair of aligned arcuate keyhole slots 18 which have a curvature in the form of a circular arc. Extending downward from the underside of base assembly 16 are a pair of aligned clamping rods or bolts 20 engaged in slots 18 for releasably securing base assembly 16 to base plate 15. Base assembly 16 is secured or clamped to the base plate 15 by first placing base assembly 16 on base plate 15 so that the respective heads 20A of clamping bolts 20 engage the larger section 18A of the respective keyhole slots 18. Base assembly 16 then is twisted or turned or rotated so the shafts of clamping bolts 20 slide into the narrower section of the keyhole slots 18 and, when in position, are then clamped securely in place within the respective slots. Each of the clamp bolts 20 is threaded into the barrel 21 at the end of a lever arm 22 which has cammed curved surfaces 23 on each side of barrel 21. In the illustrated embodiment, lever arms 22 are raised to unclamp the base assembly 16 from base plate 15 so that base assembly 16 can be moved to place the clamping bolts into the respective slots 18. After the base assembly has been turned so that the clamping bolts are in position, usually at the end of slots 18, lever arms 22 are swung downward to draw up bolts 20 by virtue of their attachment to barrels 21 and the action of the cammed curved surfaces 23 so that the bolt heads 20A clamp securely in their respective slots 18 to tightly clamp base assembly 16 to base plate 15. Depending on the manner of the mechanical linkage between the bolts 20 and the barrels 21, the bolts can be clamped and released by either raising or lowering lever arms 22. Alternatively, clamping bolts 20 may be clamped by other mechanical means, e.g., by being threaded into a manually operable threaded knob (not shown) located on base assembly 16.

To aid in securely holding the base assembly 16 onto the base plate 15 and to minimize wobble, the upper side of the latter has a somewhat convex shape and the underside of the base assembly 16 is somewhat concave so that when the two are clamped together the frictional engagement between outer edges or peripheries of the respective members further aids to hold the base plate and base assembly tightly together to provide additional protection against any wobble.

Because of its low profile base plate 15 does not present a major obstacle or impediment even though it remains on the boat deck after the base assembly and table top have been removed. Typically, the base plate may have a height in the range of about ¼" to ⅝" inches and a diameter in the range of about 5 to 9 inches.

I claim:

1. Mounting device for removably coupling boat apparatus to the deck of a boat, comprising:

a) a low profile generally circular base plate for resting on and for securing to a boat deck said base plate having a convex shape on its upper side;

b) a curved slot formed on the upper side of said base plate;

c) a generally circular base assembly having a concave shape on its underside for resting on the upper side of said base plate, said base assembly having means on its upper side for securely coupling the base assembly to the underside of a boat apparatus;

d) a clamping device extending from the bottom of said base assembly for engaging said base plate slot; and e) a manually operable member mounted on said base assembly engaged with said clamping device for releasably tightly securing said clamping device in said base plate slot.

2. A mounting device as described in claim 1 wherein said slot is in the form of a circular arc.

3. A mounting device as described in claim 1 wherein said base plate slot is a keyhole slot.

4. A mounting device as described in claim 1 further including a rigid pedestal for engaging said base assembly coupling means at one end and extending upward from said base assembly for coupling to the underside of a boat apparatus at the other end.

5. A mounting device as described in claim 1 wherein said manually operable member for releasably securing the clamping device comprises a lever arm coupled to said clamping device.

6. A mounting device as described in claim 1 wherein said base plate has a plurality of curved slots and said base assembly has a corresponding plurality of clamping devices.

7. A mounting device as in claim 4 wherein said base assembly coupling means comprises a generally centrally located opening dimensioned to accept and securely hold the lower portion of said pedestal.

8. A method for mounting apparatus onto a boat deck, comprising the steps of:

a) attaching a generally circular low profile base member to the deck of a boat, said base member having a convex shape on its upper side and a circular arc slot on its upper side;

b) placing a base assembly over said base member, said base assembly having means for securely coupling the base assembly to the underside of a boat apparatus on its upper side and having a concave shape on its underside and a clamping device for engaging said circular arc slot on its underside with said clamping device inserted into the circular arc slot on the base member; then c) turning the base assembly to secure the clamping device in place in the circular arc slot; and, then d) tightening the clamping device firmly in the slot.

9. The method as described in claim 8 in which the circular arc slot in the base member is a keyhole configuration.

10. The method as described in claim 8 in which the base member has multiple circular arc slots and the base assembly has corresponding multiple clamping devices, each of said clamping devices inserted into a corresponding arc slot.

* * * * *